United States Patent [19]

Masters

[11] Patent Number: 4,820,216

[45] Date of Patent: Apr. 11, 1989

[54] ADJUSTABLE KAYAK PADDLE

[76] Inventor: William E. Masters, 313 Dogwood La., Easley, S.C. 29640

[21] Appl. No.: 148,055

[22] Filed: Jan. 25, 1988

[51] Int. Cl.[4] ..... B63H 16/04

[52] U.S. Cl. ..... 440/101; 416/70 R

[58] Field of Search ..... 440/101, 102; 416/72, 416/74, 70 R; 403/83, 104, 109, 118, 342, 348, 344, 350, 371; 12/215

[56] References Cited

U.S. PATENT DOCUMENTS

| | | | |
|---|---|---|---|
| 3,362,033 | 1/1968 | Fee | 416/72 |
| 4,076,437 | 2/1978 | Mazzolla | 403/109 |
| 4,508,466 | 4/1985 | Dennis | 403/342 |

FOREIGN PATENT DOCUMENTS

| | | | |
|---|---|---|---|
| 1353289 | 1/1964 | France | 416/72 |
| 856766 | 12/1960 | United Kingdom | 416/72 |
| 1312320 | 4/1973 | United Kingdom | 440/101 |

*Primary Examiner*—Sherman D. Basinger

*Assistant Examiner*—Edwin L. Swinehart

*Attorney, Agent, or Firm*—Cort Flint

[57] ABSTRACT

An adjustable paddle (A) is disclosed which includes an adjustable joint (C) which allows for two handle sections (14, 16) to be fitted together in a desired axial and rotational positions to fix the length of paddle (A) and the relative blade angle settings of blades (18, 20). The adjustable joint includes three concentric shafts (22, 24, 28; and 62, 64, 66) to provide a more rigid joint which is generally wobble-free. Preferably, the concentric shafts are fixed together by a compression lock (30). The compression lock includes an annular compression member (32) and beveled edges (38, 58, 70) affixed on the first handle section and a complimentary beveled surface (**34*a*) on compression nut (34). Tightening of the compression nut forces compression member (32) about the shaft of the second handle section to fit the handle sections together in the desired axial and rotational position. Additionally, a cam lock (26**) may also be utilized to alternately lock the handle sections together.

15 Claims, 3 Drawing Sheets

ADJUSTABLE KAYAK PADDLE

BACKGROUND OF THE INVENTION

The invention relates to an adjustable boat paddle, and particularly to a double bladed kayak paddle which may be adjusted in its length and blade angles. The paddle may be broken down into two parts for storage and transportation. Kayaking has grown increasingly in popularity over the years. Kayaking is a customized boating sport in which the kayak paddle needs to be customized for a particular boater. Often, when it is attempted to manufacture the paddle by fitting two pieces together, much of the structural integrity of the one-piece structure is lost. Preserving the structural integrity is particularly important in white-water kayaking. Normally, an extra paddle is not carried in the kayak. If the two-piece construction is not strong enough to survive the rigorous encounters during kayaking, the paddle may fail and the boater may be left on the water without a paddle. While there has been a need for a two-piece kayak paddle which is fully adjustable in length and blade angles, this has been difficult due to the structural integrity needed when joined together as one-piece.

This need was met in part in U.S. Pat. No. 4,605,378 by an adjustable kayak paddle which could be broken down and assembled with the blade angle at ninety degree increments. An interior sleeve provided some structural rigidity to the joint of the paddle. However, the paddle may not be adjusted in its length. The blade angle is set in ninety degree increments and it is not possible to customize the blade angle setting by variances in degrees.

Persons engaged in kayaking normally have a preference for the type of paddle control that is used to paddle the kayak. In a paddle which is controlled by the right hand, the wrist of the right hand is utilized to rotate the paddle ninety degrees on alternate strokes so that the face of the paddle blade properly enters the water. The shaft of the paddle is held loosely in the left hand and rotated by the wrist of the right hand on the left hand stroke. In a left hand control paddle, the opposite is true. The left hand grips the paddle and the wrist of the left hand rotates the paddle generally ninety degrees as it is held loosely in the right hand. Right and left hand control paddles are also used in feathered and non-feathered configurations. Generally, kayak paddles are used in a no usually feathered configuration. A paddle that has been designed for left or right hand control may be set to a non-feathered position and the paddle can normally be used by anyone.

Kayak paddles typically have been sold in a fixed length to suit the physical size and paddling style of the kayaker. Blade angles have been sold both parallel (non-feathered) and 90 degrees, right and left hand control. The trend is to adjust and offset the blade angles between 50 and 90 degrees to allow the kayaker to reach a physical compromise which reduces windage of the top blade as well as make the kayak easier to eskimo row. To make and stock a wide range of customized paddles is expensive and to stock a wide variety of feathered paddles to suit all needs is highly impractical.

An adjustable break-down boat paddle is illustrated in British Patent No. 1,312,320 showing an orr which can be taken apart. The sections of the orr are scarfed so that they fit together and form a tight joint. A threaded nut is tightened down over a threaded section to make a tight joint. The construction does not take into account double bladed paddles having multiple operational positions wherein the blades re-oriented at different angles with respect to each other, nor to the structural integrity of the joint as required by rigorous white-water rafting. Further, it is not possible to adjust the length of the paddle by this type of joint. U.S. Pat. No. 3,970,032 discloses a boat paddle having a blade which can be set at different angles for varying the pitch. A quick release coupling is provided.

Accordingly, an object of the invention is to provide an adjustable kayak paddle which may be readily customized in length and blade angle for any kayaker.

Another object of the invention is to provide a joint having increased strength for an adjustable length and adjustable blade angle paddle.

Another important object of the invention is to provide a kayak paddle having an adjustable joint which allows for adjusting the length of the paddle and for infinitely adjusting the angle at which the blades may be set relative to each other.

Still another object of the invention is to provide an adjustable kayak paddle which may be broken down into two pieces, adjusted in its length as one-piece with different blade angle settings, and a joint for adjustability and breakdown which has increased structural integrity.

SUMMARY OF THE INVENTION

The above objectives are accomplished according to the present invention by providing a paddle for a kayak and the like in which a handle extending between a pair of paddle blades may be adjusted in its length and rotated to set the paddle blades at any desired, feathered, and control position. The handle is made of two sections which may be rotated relative to each other in an infinite variety of angularly positions and locked by the adjustable joint according to the invention. Increased structural integrity is provided by utilizing concentric shafts nested within each other. The adjustable joint is carried by one handle section and includes first and second concentric cylindrical shafts. The second handle section includes a third concentric shaft which fits between the first and second concentric shafts. A cam lock and/or a compression lock may be used to fasten the handle sections together in any one of an infinite variety of angular positions and adjustable length positions as the handle sections slide within each other.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
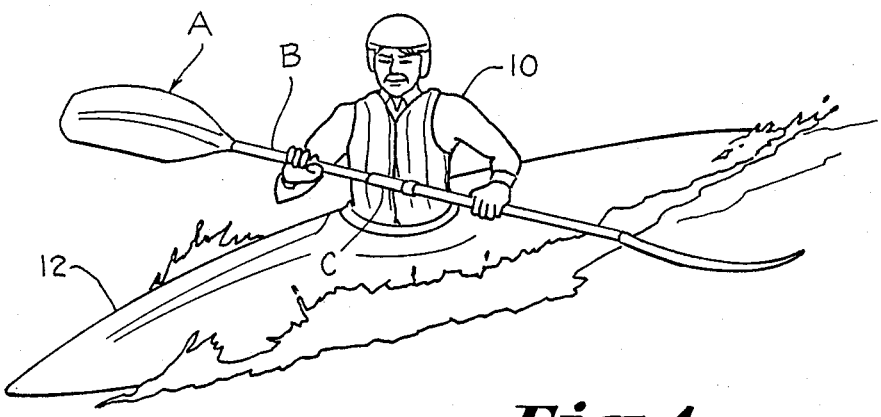
FIG. 1 is a perspective view illustrating a kayaker utilizing an adjustable paddle constructed in accordance with the present invention.

The invention relates to an adjustable kayak paddle having a handle with a paddle blade on each end of the handle in which both the length of the handle and angle of the blades may be adjusted. The paddle may be adjusted in its length and feathered to an infinite number of blade angles allowing one paddle to be customized for any kayaker.

Referring now in more detail to the drawings, the invention is illustrated in the form of an adjustable kayak paddle designated generally as A, having a handle C with an adjustable joint B and paddle blades at each end. The paddle may be used by a kayaker 10 in a kayak 12, as can best be seen in FIG. 1. The adjustable paddle A includes a first handle section 14 and a second handle section 16 joined together by adjustable joint B. A first blade 18 is carried by an end of handle section 14 and a second blade 20 is carried by an end of handle section 16.

Figure 3:
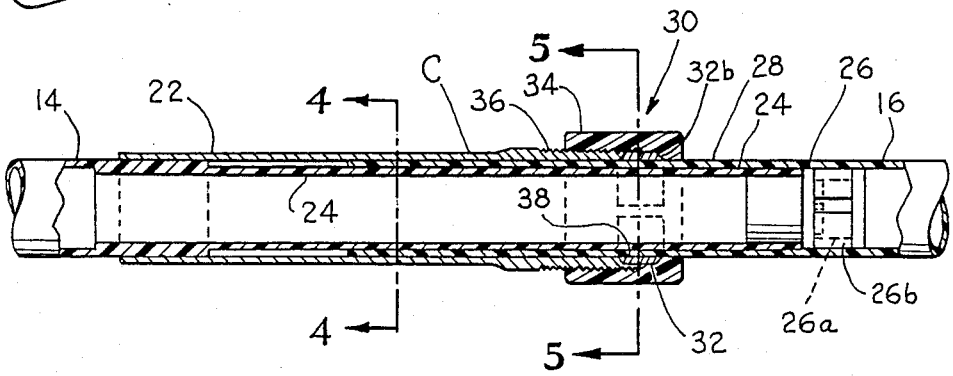
FIG. 3 is a partial cut away view taken along line 3—3 of FIG. 2.
Figure 4:
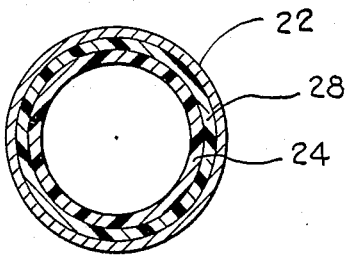
FIG. 4 is a sectional view taken along line 4—4 of FIG. 3.
Figure 5:
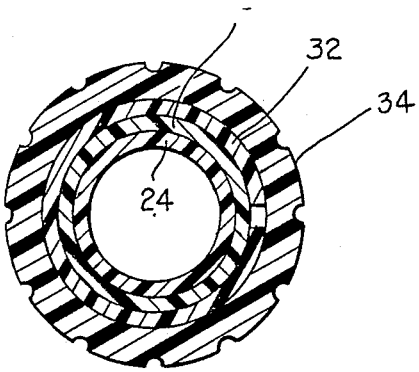
FIG. 5 is a sectional view taken along line 5—5 of FIG. 3.
Figure 10:
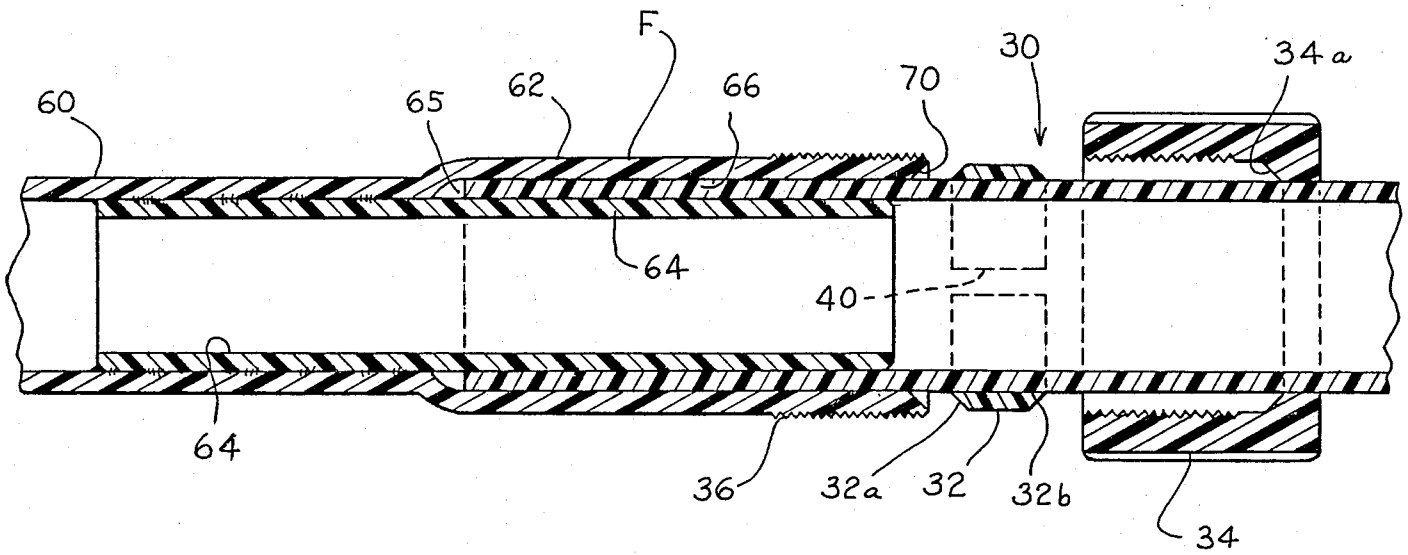
FIG. 10 is another embodiment of an adjustable joint for an adjustable kayak paddle according to the invention.

Adjustable joint C adjusts the length of handle B and the angular position or feathering of blades 18 and 20. As can best be seen in FIG. 3, adjustable joint C includes a pair of concentric shafts 22 and 24 carried by first handle section 14. First concentric shaft 22 is illustrated in FIG. 3 as a tube affixed to the outer diameter of handle section 14. Alternately, concentric shaft 22 may be made in one piece with handle section 14 and concentric shaft 24 may be inserted and glued inside shaft 22 as illustrated in FIG. 10 as 62 and 64, respectively. As illustrated in FIGS. 3-5, second concentric shaft 24 is formed as one piece with the tubular handle section 14 and extends forward of concentric shaft 22. At the end of concentric shaft 24 is affixed an eccentric cam lock 26. Second handle section 16 includes a cylindrical shaft 28 which forms a third concentric shaft fitting between first and second concentric shafts 22 and 24 in joint C. Cam lock 26 extends within the inner diameter of handle section 16. Cam lock 26 may be any conventional cam lock which locks concentric shafts 24 and 28 together when twisted about a quarter turn. This allows for the relative axial adjustment of handle sections 14 and 16 and the overall length of handle B. Feathering of blades 18 and 20 may also be adjusted. Basically, cam lock 26 includes an eccentric post **26*a* and a split eccentric collar 26*b* which rotates about eccentric post 26*a*. Relative rotation forces collar 26*b* outward as it rises on eccentric post 26*a* into a wedged, locking position with the interior surface of handle section 16**. A suitable lock is available from L. S. Brown Company of Atlanta, Ga.

As illustrated in FIG. 3, the adjustable joint also includes a compression lock means designated generally as 30 which can best be seen in FIG. 10. The compression lock means includes a split annular compression member or ring 32 having beveled edges **32*a* and 32*b*. A threaded compression nut 34 is threaded on exterior threads 36 formed on outer concentric shaft 22. Nut 34 is open for receiving handle section 16 extending through the nut. A complimentary beveled edge 38 and 70 is formed on the inside edges of concentric shaft 22 and 64. Corresponding complimentary beveled edges 34*a* is formed around the interior of compression nut 34 (FIG. 10). As compression nut 34 is threaded upon threads 36 and split ring 32 is compressed between beveled edges 38 and 34*a* causing the ring to close upon itself and close a gap 40 between its opposing edges. The compression lock means 30 also provides a water tight seal so that water does not run down the handle sections into the joint and into the paddle. Split ring 32 tightens upon the outside diameter of concentric shaft 28 locking the same against rotation and axial movement. Compression lock means 30 provides infinite adjustment in the angular settings of blades 18 and 20. It may not be necessary to include cam lock 26 in any or all applications. Cam lock 26 may be added as a supplementary locking means. In combination with cam lock 26, cam lock 26 may be locked and then compression nut 30 tightened to further lock the handle sections with compression ring 32. Alternately, without cam lock 26, the handle sections are adjusted for length and blades 18 and 20 for any degree of feathering, and then compression nut 34 is tightened preventing any axial or rotational movement of the handle sections relative to each other. In these ways, adjustable paddle A may be set in any of the feathered or shortened configurations of FIGS. 2 and FIGS. 7-9**.

Figure 2:
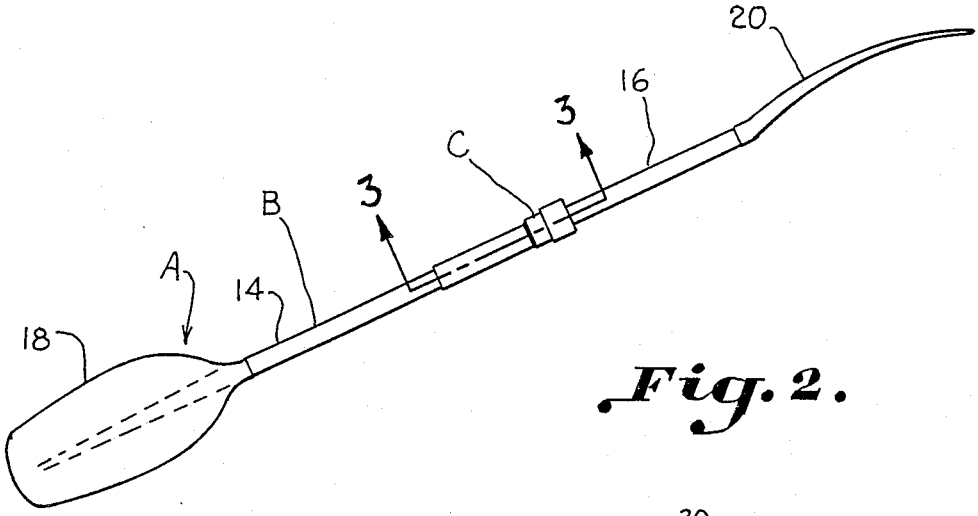
FIG. 2 is an elevation of an adjustable kayak paddle constructed in accordance with the invention shown in a feathered, right hand control.
Figure 6:
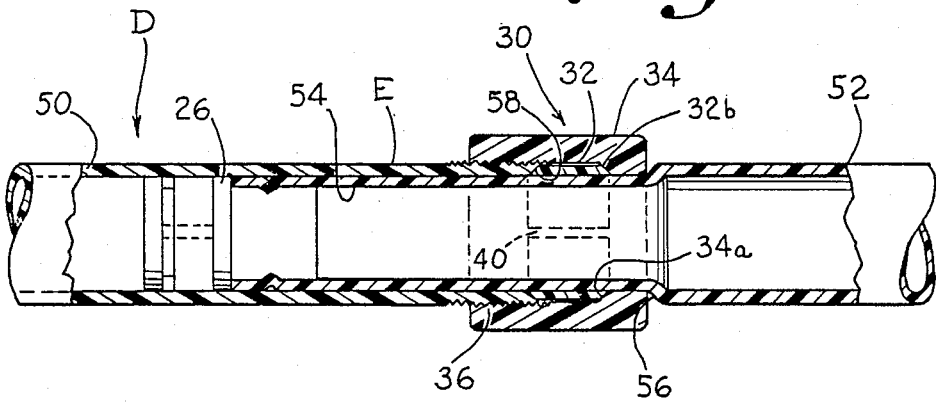
FIG. 6 is a partial cut away view of an alternate embodiment of an adjustable joint according to the invention.
Figure 7:
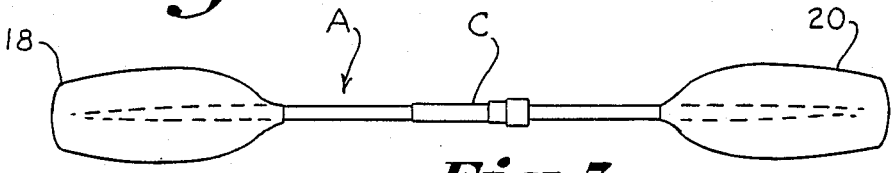
FIG. 7 is a front elevation showing the adjustable paddle of the present invention in a non-feathered configuration.
Figure 8:
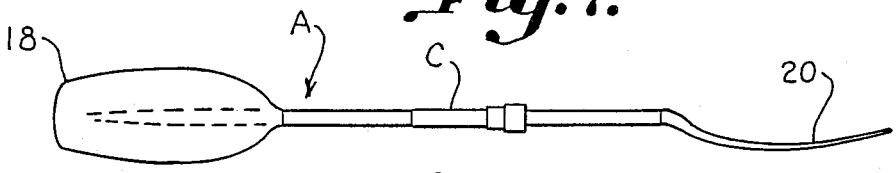
FIG. 8 is an elevation of the paddle of FIG. 7 in a feathered, left-hand control configuration.
Figure 9:
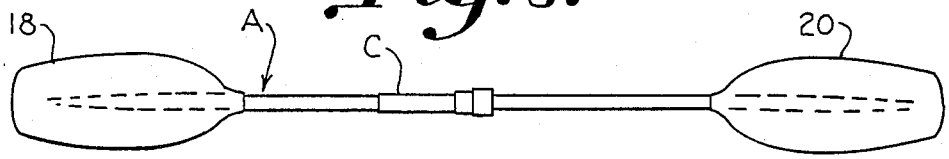
FIG. 9 is an elevation illustrating the adjustable kayak paddle in a non-feathered configuration with its handle lengthened by an adjustable joint according to the invention.

Referring now to the embodiment of FIG. 6, it can be seen that an adjustable kayak paddle, designated generally as D, is provided having opposed blades as shown in FIG. 2. Adjustable joint E joins handle sections 50 and 52. In this case handle sections 50 and 52 have the same outside diameter while handle section 52 has a reduced outside diameter cylindrical shaft 54 which fits within inside diameter of handle section 52. A shoulder 56 provides for the reduction in diameter of handle section 52. Compression nut 34 is again used with compression ring 32 to seal and lock the handle sections. Further, cam lock 26 may be carried by the end of fitted shaft section 54. Beveled edge 58 formed on the end of handle section 50 allows for tightening of compression ring 32. The combination provides for an adjustable boat paddle which is essentially uniform in its appearance and diametrical cross-section except for the presence of compression nut 34.

Referring to the embodiment of FIG. 10, an adjustable boat paddle, as in FIG. 1, is illustrated having a preferred, adjustable joint F, which is a variation of the adjustable joint C of FIG. 2 without cam lock 26. In this embodiment, handle section 60 includes a first cylindrical concentric shaft 62 which is molded or made as one piece with handle section 60. A second, concentric shaft 64 is affixed to shaft 62 by adhesive or other suitable means. A space 65 is defined between concentric shafts 62 and 64 in which a shaft 66 of handle section 68 is concentrically received. The sandwich concentric configuration of concentric shafts 64, 66, and 62 provides for rigidity and structural integrity in the joint. Concentric shaft 66 may be moved axially and rotatably in this space for adjustment. Beveled edges 70 are formed on the end of handle section 60 for compression of ring 32. Threads 72 formed on shaft 62 mate with compression nut 34.

While any suitable material may be used for the adjustable kayak paddle and its locking parts, fiberglass material has been found suitable for the handle B and a plastic may be used for the paddle blades.

Thus, it can be seen that a highly advantageous construction can be had for an adjustable boat paddle whose length and blade angle settings may be customized to fit the needs of any particular kayaker. An adjustable joint with the fitting of three concentric shafts provides structural integrity while a compression lock provides for more precise blade angle settings since adjustment is essentially infinite. The compression lock also provides an effective water-tight seal with or without a cam lock.

While a preferred embodiment of the invention has been described using specific terms, such description is for illustrative purposes only, and it is to be understood that changes and variations may be made without departing from the spirit or scope of the following claims.

What is claimed is:

1. An adjustable kayak paddle having a handle with a blade fixed at each end of the handle comprising:

a first handle section having a first blade attached to one end;

a second handle section having a second blade affixed to one end;

an adjustable joint for joining said first and second handle sections together which includes a first hollow cylindrical shaft carried by said first handle section;

a second cylindrical shaft carried by said first handle section concentric with said first shaft defining a space between said first and second concentric shafts;

a third cylindrical shaft carried by said second handle section receivable between said first and second concentric shafts to form first, second, and third concentric shafts fitted concentrically together;

compression lock means for locking said first and second handle sections together with said shafts fitted concentrically together, and for sealing said joint to provide a water-tight seal between said first and second handle sections at said joint;

said compression lock means including a compression nut fitted over exterior threads formed on an outside diameter of said first concentric shaft and interior threads formed on an inside of said compression nut;

a split annular compression member adapted for being carried around said outside diameter of said third concentric shaft having free ends defining a gap;

complimentary beveled surfaces carried by said first handle section and said compression nut; and said compression member including beveled edges which cooperate with said complimentary beveled edges for compressing said compression ring causing said free ends to move together and close said gap to tighten upon said third concentric shaft and fit said first and second handle sections together in a manner that once adjusted to a desired length and rotational blade angle position said first handle sections are locked together.

2. The apparatus of claim 1, wherein said complimentary beveled surfaces include a first beveled surface formed on an end of said first concentric shaft and a second beveled surface formed around an interior of said compression nut, said compression nut being open around said compression nut for receiving said second handle section through said compression nut.

3. The apparatus of claim 1 including a cam lock formed on an end of said second concentric shaft for engaging an interior diameter of said third concentric shaft to provide a supplementary lock against axial and rotational movement between said handle sections.

4. An adjustable kayak paddle comprising:

a first handle section having a first blade attached at one end;

a second handle section having a second paddle blade affixed to one end;

an adjustable joint for joining said first and second handle sections together and adjusting the relative axial position of said first and second handle sections relative to each other;

said second handle section having a cylindrical shaft with a reduced diameter which fits within said first handle section;

first threads formed on an outside diameter of said first handle section;

a compression nut received over said second handle section having interior threads for mating with said first threads;

an annular compression member received over said shaft of said second handle section having opposing free ends defining a gap, said annular compression member having outer beveled edges and a planar interior bearing surface extending between said outer beveled edges on an interior circumference of said annular compression member which bears against said shaft of said second handle section; and complimentary beveled surfaces formed on an end of said first handle section and on said compression nut for compressing said compression member forcing said opposing ends towards each other to close said gap in a manner that said interior bearing surface of said compression member tightens upon said shaft of said second handle section to positively lock said first and second handle sections together against rotational and axial movements.

5. The apparatus of claim 4 including a cam lock carried on an end of said reduced shaft of said second handle section for locking against an interior diameter of said first handle section.

6. The apparatus of claim 4, wherein said complimentary beveled surfaces include a first beveled surface formed on an end of said first concentric shaft and a second beveled surface formed around an interior of said compression nut, said compression nut being open around said compression nut for receiving said second handle section through said compression nut.

7. The apparatus of claim 4, wherein said first and second handle sections have the same outside diameter and said reduced diameter of said cylindrical shaft of said second handle section has an outside diameter generally equal to the inside diameter of said first handle section.

8. An adjustable kayak paddle having a handle with a blade affixed at each end of the handle comprising:

a first handle section having a first blade affixed to one end;

a second handle section having a second blade affixed to one end; and an adjustable joint for joining said first and second handle sections together in such a manner that they may be adjusted axially and rotationally with respect to each other to fix the length of said paddle and the angles at which said blades are set relative to each other, said adjustable joint including:

a first cylindrical shaft carried by said first handle section;

a second cylindrical shaft carried by said first handle section concentrically with said first cylindrical shaft;

an annular concentric space defined between said first and second concentric shafts;

a third cylindrical shaft carried by said second handle section receivable in said annular space so that said first, second, and third shafts are fitted concentrically with respect to each other over a significant portion of their length so that a generally wobble-free joint is provided; and lock means for locking said first and second handle sections together in said axially and rotational position to adjust the length and blade angle settings of said paddle.

9. The apparatus of claim 8, wherein said lock means comprises a compression lock means carried by said first and second handle sections which compresses said concentric shafts to lock said handle sections in said desired axial and rotational positions to provide infinite blade angle settings.

10. The apparatus of claim 9, wherein said compression lock means comprises a compression nut received over said second handle section;

an annular compression member received over said third shaft carried by said second handle section having opposed free ends defining a gap; and complimentary beveled surfaces formed on an end of said first handle section and on said compression nut for compressing said compression member forcing said opposing ends together to close said gap in a manner that said compression member tightens upon said third shaft and locks said first and second handle sections together axially and rotationally.

11. The apparatus of claim 10, wherein said lock means further includes an eccentric cam lock carried by an end of said second concentric shaft which supplements said compression lock means and further locks said second and third shaft together to lock said first and second handle sections in said desired position.

12. The apparatus of claim 11, wherein said cam lock includes an eccentric post carried by an end of said second shaft, and an eccentric collar carried about said eccentric post which twists to an eccentric position against which said eccentric cam is wedged between said post and said third shaft.

13. The apparatus of claim 8, wherein said first and second shafts are formed as two pieces affixed together by adhesive.

14. The apparatus of claim 8, wherein said lock means further includes an eccentric cam lock carried by an end of said second concentric shaft which supplements said compression lock means and further locks said second and third shaft together to lock said first and second handle sections in said desired position.

15. The apparatus of claim 14, wherein said cam lock includes an eccentric post carried by an end of said second shaft, and an eccentric collar carried about said eccentric post which twists to an eccentric position against which said eccentric cam s wedged between said post and said third shaft.

* * * * *